US005286348A

United States Patent [19]

Perin

[11] Patent Number: 5,286,348

[45] Date of Patent: Feb. 15, 1994

[54] ELECTRONIC FLOW MODULATED CROSS DIRECTION MOISTURE ACTUATOR

[75] Inventor: Didier J. Perin, Toronto, Canada

[73] Assignee: Valmet Automation (Canada) Ltd., Concord, Canada

[21] Appl. No.: 777,583

[22] Filed: Oct. 16, 1991

[51] Int. Cl.[5] ..... D21F 7/00

[52] U.S. Cl. ..... 162/262; 162/198; 162/DIG. 6; 162/252; 162/253

[58] Field of Search ..... 162/198, 262, DIG. 6, 162/252, 253; 251/129.08, 129.04, 129.11; 137/487.5

[56] References Cited

U.S. PATENT DOCUMENTS

| | | | |
|---|---|---|---|
| 2,951,007 | 8/1960 | Lippke | 162/DIG. 6 |
| 3,485,264 | 12/1969 | Schulze, Jr. | 137/487.5 |
| 3,934,816 | 1/1976 | Terrell et al. | 251/129.08 |
| 4,053,137 | 10/1977 | Raymond | 251/129.08 |
| 4,182,384 | 1/1979 | Berg | 251/129.08 |
| 4,193,421 | 3/1980 | Sakakibara et al. | 251/129.08 |
| 4,351,700 | 9/1982 | Dove | 162/252 |
| 4,441,341 | 4/1984 | Otting | 68/205 R |
| 4,474,212 | 10/1984 | Schmitz | 251/129.08 |
| 4,481,451 | 11/1984 | Kauntz et al. | 251/129.04 |
| 4,642,164 | 2/1987 | Hanhikoski et al. | 162/207 |
| 4,662,398 | 5/1987 | Wywailowski et al. | 137/625.4 |
| 4,836,894 | 6/1989 | Chance et al. | 162/253 |
| 4,873,407 | 10/1989 | Smith | 219/10.43 |
| 5,065,673 | 11/1991 | Taylor et al. | 100/40 |

*Primary Examiner*—W. Gary Jones
*Assistant Examiner*—Brendon A. Lamb
*Attorney, Agent, or Firm*—Shenier & O'Connor

[57] ABSTRACT

A web rewet moisture actuator in which a plurality of air atomizing nozzles at spaced locations along a boom extending across the web are supplied with air under pressure by an air manifold on the boom and are supplied with water from a water manifold on the boom through respective proportional valve assemblies which permit flows therethrough in proportion to the magnitudes of control signals applied to the assemblies. A unit located downstream of the boom obtains a moisture profile across the web from which location and control signals are derived and fed to the valve assemblies to control the liquid flow through the valve assemblies in proportion to the magnitudes of the control signals.

5 Claims, 2 Drawing Sheets

FIG. 1
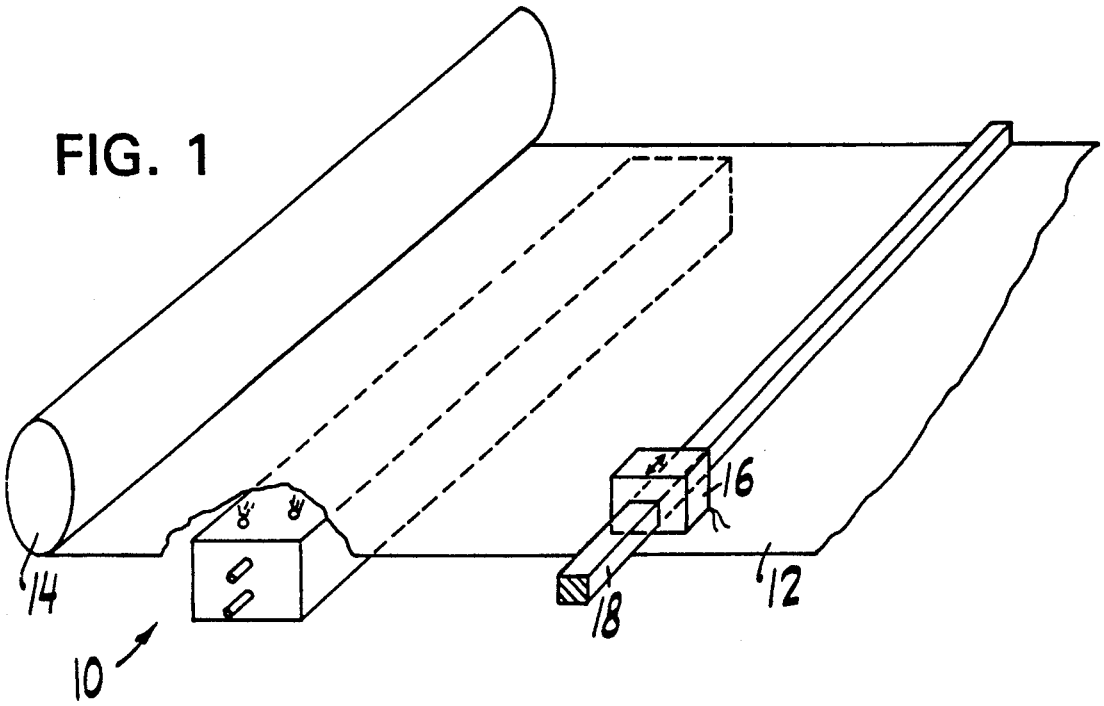
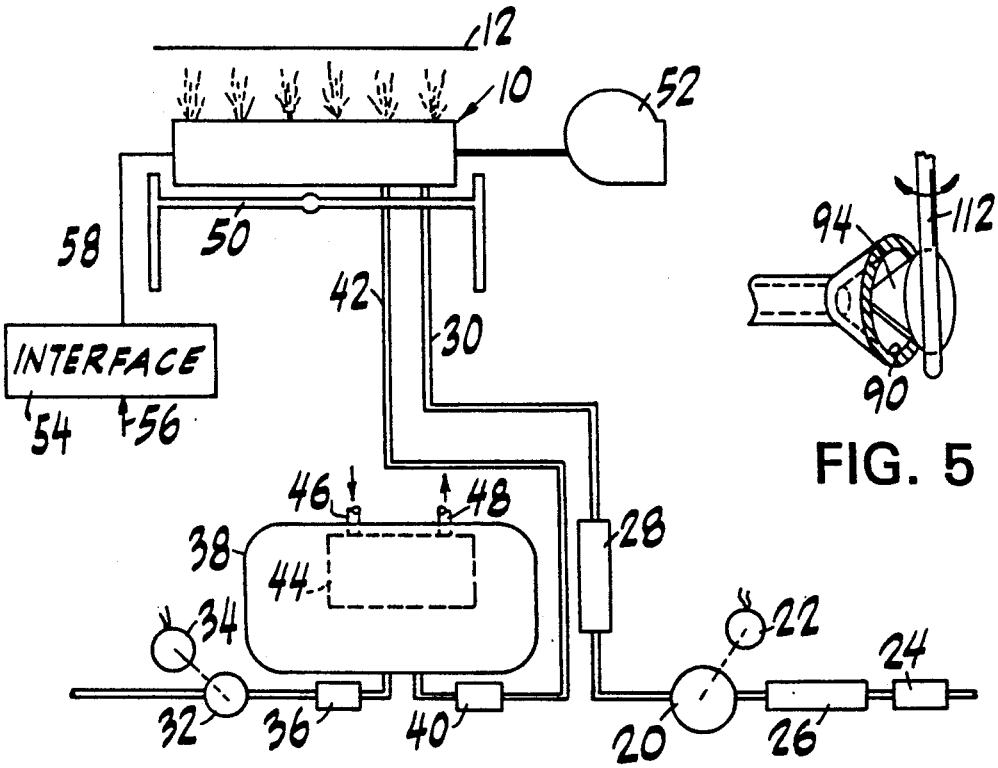
FIG. 2
FIG. 5

ELECTRONIC FLOW MODULATED CROSS DIRECTION MOISTURE ACTUATOR

FIELD OF THE INVENTION

The invention is in the field of papermaking and more specifically it relates to an improved rewet moisture actuator for rewetting the paper web formed by a paper machine.

BACKGROUND OF THE INVENTION

In the manufacture of paper, the web emerging from the dryer section of the paper machine generally has an irregular moisture content in a direction transverse to the direction of web travel. For subsequent processing and testing operations, it is desirable that the web have as uniform a moisture profile in the cross web direction as is possible.

Various sytems have been devised in the prior art in attempts to maintain a relatively uniform cross web moisture content profile. In all of these systems, a cross web moisture content profile is taken and control signals derived therefrom are fed to a rewet actuator which applies moisture to the web.

In one fiber rewet actuator known to the art, solenoid type valves are used to control the flow of water through a spray nozzle onto the web. In an effort to achieve some measure of resolution, a number of solenoid valves configured in parallel are associated with each nozzle. Generally, this type of rewet actuator requires that four solenoid valves be provided per nozzle. This is independent of the number of data zones across the web. A single zone may have one, two or even three nozzles so that the number of solenoid valves required for the actuator is relatively large. Thus, actuators of this type are large and bulky and require an inordinate amount of machine floor space for cabinets containing the control valves. In addition, the large number of components required for these systems results in high failure rates and long troubleshooting periods. A typical system having one hundred data zones would have a minimum of four hundred solenoid valves.

In addition, in a system of the type described hereinabove, any customizing which must be done on-site results in a major down time of the system. Fine tuning of the system is lengthy and complex. Nozzles must be evenly matched in performance or any mismatch causes a notable error in the moisture profile.

In any system during a web break the spray boom does not spray any water. Where air atomizing nozzles are used the air continues to flow while the water is shut off. During the period when the water is shut off, the water supply units build up some pressure. When the web is back on line, the solenoid having the lowest flow rate in the parallel configuration is opened. Owing to the high pressure which has built up in the supply unit during the down time, the spray boom will always overshoot the amount of moisture required. Such overshoot continues until pressure in the water supply unit drops to the proper level.

As an alternate to the use of solenoid valves, it has been proposed to use a needle type valve with a stepper motor for positioning the valve shaft. Along with other problems, this arrangement suffers from low resolution and backlash.

SUMMARY OF THE INVENTION

One object of my invention is to provide a cross direction moisture actuator which overcomes the problems present in actuators of the prior art.

Another object of my invention is to provide a cross direction moisture actuator which provides extremely low water flow rates.

A further object of my invention is to provide a cross direction moisture actuator having high resolution capability.

Still another object of my invention is to provide a cross direction moisture actuator which overcomes the problem of inlet water pressure variation to the valves.

Yet another object of my invention is to provide a cross direction moisture actuator which overcomes the problems of air pressure variants in the atomization process.

Still another object of my invention is to provide a cross direction moisture actuator which overcomes the problem of differential pressure drops across the air and water supply manifolds.

A still further object of my invention is to provide a cross direction moisture actuator which is not affected by individual nozzle performance.

Yet another object of my invention is to provide a cross direction moisture actuator which is not affected by individual valve performance.

A further object of my invention is to provide a cross direction moisture actuator which operates in a closed loop system.

Other and further objects of my invention will appear from the following description.

BRIEF DESCRIPTION OF THE DRAWINGS

In the accompanying drawings to which reference is made in the instant specification and which are to be read in conjunction therewith and in which like reference numerals indicate like parts in the various views:

FIG. 1 is a schematic view of my cross direction rewet actuator in association with the last dryer section of a paper-making machine.

FIG. 2 is a diagrammatic view of my cross direction rewet actuator and its associated air, water and electrical signal supplies.

FIG. 5 is a perspective view of the proportional valve employed in my cross direction rewet actuator.

DESCRIPTION OF THE PREFERRED EMBODIMENT

Figure 3:
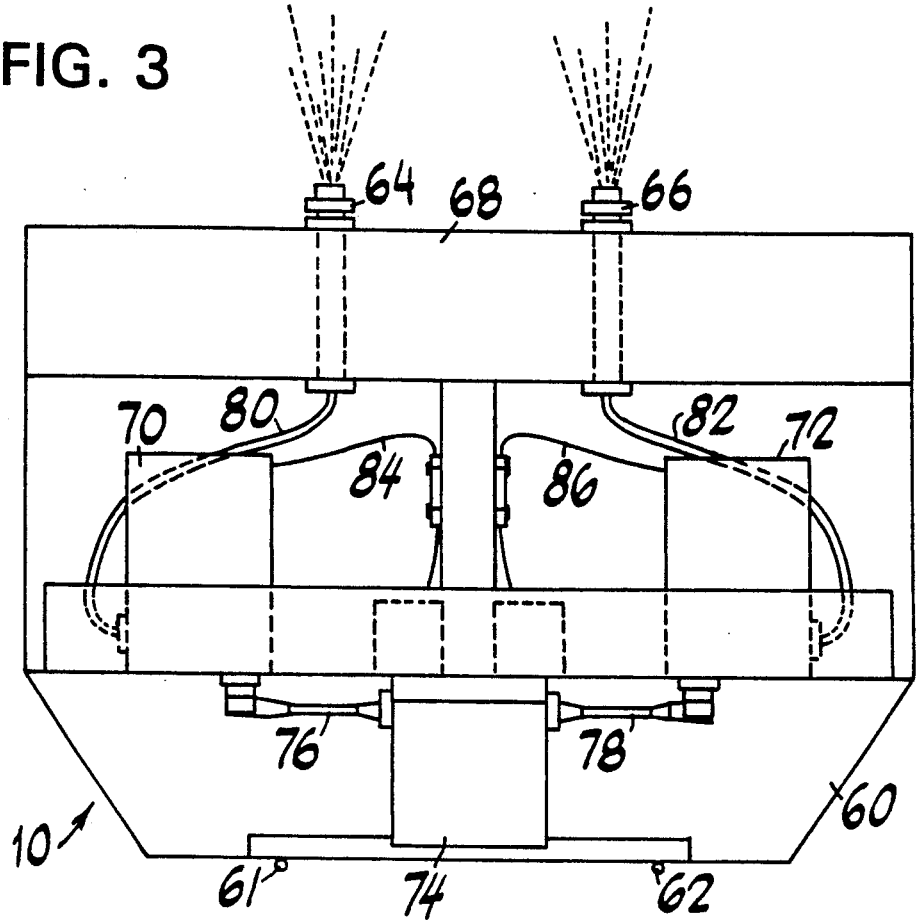
FIG. 3 is an end elevation of my cross direction rewet actuator.

Referring now to FIG. 1, my improved cross direction moisture actuator indicated generally by the reference character 10 extends across and below a paper web 12 emerging from the last dryer roll 14 of the dryer section of a paper machine. Associated with my rewet actuator 10 is an infrared moisture sensor indicated schematically by the block 16 which is adapted to travel across the web 12 on a guide bar 18. As is known in the art, the device 16 produces an output signal representing the moisture profile in a direction transverse to the direction of travel of the web 12. This profile is used to energize the operating mechanism of the moisture actuator proportional valves to be described hereinbelow.

Referring now to FIG. 2, air is supplied to the actuator 10 by means of a Roots blower 20 driven by a motor 22. The blower 20 draws air in through an intake filter 24 and a silencer 26 and feeds this air through a second silencer 28 to a supply line 30 leading to the rewet actuator 10. The silencers 26 and 28 perform the dual functions of reducing sound and removing pulses from the air supplied by the blower 20.

A water pump 32 driven by a motor 34 supplies water to a filter 36 leading to a supply tank 38. An outlet filter 40 conducts water from the tank 38 to a supply line 42 leading to the rewet actuator 10.

Preferably, I provide some means for heating the water in tank 38. For example, I may dispose a heat exchanger 44 made up of coils of tubing within the tank 38. Steam supplied to an inlet pipe 46 is brought into indirect heat exchange relationship with the water in the tank 38 by the coils of the heat exchanger 44 and flows outwardly through an outlet pipe 48.

Preferably I provide the rewet actuator 10 with a purge blower 52 which is energized in any manner known to the art to supply purging air to the unit 10 when and as necessary or desired.

The moisture profile signal from the unit 16 is applied by a conductor 56 to an interface 54 comprising suitable circuitry for translating the signal into suitable control voltages or currents for operating the rewet actuator proportional valves in a manner to be described. These voltages or currents are applied by a channel indicated schematically by the reference character 58 to the valves of the unit 10.

Referring now to FIG. 3, the unit 10 includes a boom 60 supported by any suitable means. Hinges 61 and 62 permit the sides of the spray boom 60 to open. Boom 60 supports a plurality of air atomizing nozzles which may for example be arranged in two offset rows of nozzles 64 and 66. An air manifold 68 supplied by the line 30 provides air for the nozzles 64 and 66.

Boom 60 carries a plurality of proportional valve assemblies which may for example be arranged in two rows of assemblies 70 and 72. By way of example, in FIG. 3 I have shown the assembly 70 associated with a nozzle 64 and the assembly 72 associated with the nozzle 66. It is to be understood that one proportional valve ma be associated with a number of air atomizing nozzles per zone.

In the arrangement shown in FIG. 3, a water manifold 74 is supplied with water from the line 42. Respective conduits 76 and 78 provide the water inlets for the respective valve assemblies 70 and 72. Water lines 80 and 82 carry water from the proportional valve assemblies to the nozzles 64 and 66.

Figure 4:
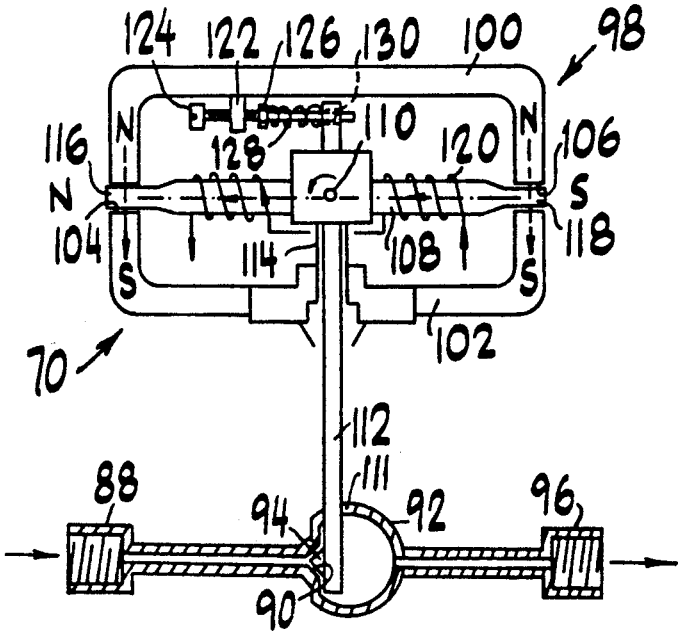
FIG. 4 is a sectional view of the proportional valve incorporated in my moisture rewet actuator and its associated operating torque motor.

Referring now to FIG. 4, I have shown the details of one of the proportional valve assemblies 70, it being understood that the construction of the other valve assemblies is the same. An inlet port 88 supplied from line 76 leads to a generally conical valve seat 90 formed in the interior of a chamber 92. Associated with the seat 90 is a generally conical valve 94. The conical configuration of the seat 90 and valve 94 is more clearly shown in FIG. 5. In a manner to be described hereinbelow, valve 94 is positioned relative to the seat 90 so as to control the flow of water from inlet port 88 through the chamber 90 to an outlet port 96 connected to the line 80. The construction of the valve 94 and seat 90, moreover, is such that the permitted flow through the chamber 9 is proportional to the distance between the valve 94 and its seat 90.

I provide a torque motor indicated generally by the reference character 98 for controlling the position of the valve 94 relative to the seat 90. The torque motor 98 includes upper and lower generally U-shaped permanent magnets 100 and 102 formed of a suitable material, such for example as ferrite. These magnets, 100 and 102, are supported in any suitable manner so that the ends of the legs thereof form gaps 104 and 106. An armature 108 is mounted for pivotal movement around a pivot 110. This armature 108 carries a vertically extending rod 112 which supports the valve 94. In one particular embodiment, the valve 94 may be a concial glass member secured to the rod 112 by an epoxy or the like. It will readily be apprecited that the rod 112 extends through a suitable water tight seal 111 in housing 92 so that the rod 112 can swing in the manner of a pendulum without the danger of water leaking out of the chamber 92. Rod 112 extends downwardly through a flexible tube 114 supported by the magnet 102.

Armature 108 is provided with ends 116 and 118 of reduced dimension which are disposed in the gaps 104 and 106. Armature 108 carries a coil 120 wound in the direction indicated by the arrows and adapted to receive a direct current signal through the channel 58 in a direction in from the right hand side of the coil, as viewed in FIG. 4, and out of the left hand side of the coil.

The polarities of the permanent magnets 100 and 102 are as shown in FIG. 4 to produce fluxes indicated by the broken lines in the Figure. It will readily be appreciated that with no current passing through the coil 120, the armature 108 is in a neutral position with its ends 116 and 118 located centrally of the air gaps 104 and 106.

With coil 120 wound as shown and with a direct current passing therethrough in the direction described hereinabove, the coil generates a flux indicated by the dot-dash lines in the FIG. 4. It will readily be seen that under these conditions, the end 116 of the armature 108 tends to move downwardly while the end 118 of the armature tends to move upwardly. The result is a counterclockwise movement of the armature around its pivot 110 to tend to move the valve 94 away from the seat 90.

A bracket 122 carried by the magnet 100 receives a screw 124. A spring 128 carried by the screw 124 bears between a collar 126 on the screw and the upper end of the rod 112 normally to urge the valve 94 against the seat 90. We provide the upper end of the rod 112 with a slot 130 for receving the end of the screw 124. From the structure just described, it will readily be appreciated that the force with which the valve 94 is held against the seat 90 can be adjusted by turning the screw 124. Further, the current supplied to the winding 120 must be of a sufficient magnitude to overcome the force of the spring 128 in moving the valve 94 away from its seat 90. Adjustment of the screw 124 sets the maximum armature deflection or maximum flow, the control range of the input signal for linearity and the location in the control range at which positive shut-off will occur. The magnetic charge level of the permanent magnets 100 and 102 sets the magnitude of the decentering force on the armature-valve assembly. In one particular embodiment, full deflection of the armature-valve assembly results in a maximum orifice opening of approximately 3/1000ths of an inch.

My rewet actuator is capable of providing ultra low water flow rates of, for example, 0.014 liters per hour. To achieve such ultra low water flow rates in an air atomizing nozzle, the length of the nozzle supply line 80 between the valve outlet and the nozzle is critical. At very low water flow rates the nozzle may sputter if the supply line is too long or too large in diameter. This sputtering is caused by the vacuum in the nozzle supply line created by the air flow through the nozzle which causes a negative pressure at the water orifice in the nozzle assembly. This vacuum will draw out water from the nozzle supply line depending on the volume capacity of the line. In order to eliminate the possibility of sputter and to ensure a positive water shutoff, I have made the nozzle supply line 80 as short as possible. This is achieved to a large degree by mounting the valves 70 and 72 on the boom itself.

Preferably I use a 4 to 20 milli ampere signal to control the proportional valves. A digital to analog converter with a high bit resolution affords a high degree of water flow resolution. My proportional valve eliminates the overshoot associated with turning on of water flow since the flow can be regulated according to the inlet pressure.

In operation of my rewet actuator the moisture profile information derived by the unit 16 is fed to the interface 54 through the input channel 56. The interface converts the moisture profile information into suitable control signals for the valve assemblies 70 and 72 by a suitable algorithm in a manner known to the art. The output channel 58 applies the control signals to the respective windings 120 of the torque motors 98. As a result, the respective valves 94 are positioned relative to their seats 90 so as to cause respective water flows to the nozzles 64 and 66 which are proportional to the signals. The result is to tend to make the moisture profile across the web 12 constant. It will be appreciated that since the unit 16 is downstream of the rewet actuator 10 with reference to the direction of web movement, the system is a closed loop system.

It will be seen that I have accomplished the objects of my invention. I have provided a cross direction rewet actuator which overcomes the defects of rewet actuators of the prior art. It is relatively small and compact as compared with systems of the prior art. It incorporates fewer components than do systems of the prior art. It readily lends itself to on-site customizing of the installation. My system overcomes the problems of inlet water pressure variation, air pressure variants, differential pressure drops across the air and water manifolds and differences in individual nozzle and valve performance.

It will be understood that certain features and subcombinations are of utility and may be employed without reference to other features and subcombinations. This is contemplated by and is within the scope of my claims without departing from the spirit of my invention. It is, therefore, to be understood that my invention is not to be limited to the specific details shown and described.

Having thus described my intention, what I claim is:

1. A system for rewetting a paper web traveling in a direction away from the dryer section of a paper machine including in combination a support extending across said web in a direction generally perpendicular to the direction of travel of the web, a plurality of air atomizing nozzles spaced along the length of said support for directing sprays of water against the surface of said web, means for supplying said nozzles with air under pressure, respective proportional valve assemblies associated respectively with said air atomizing nozzles, each of said proportional valve assemblies having an inlet and an outlet and comprising a seat and a valve member movable relative to said seat and an individual electromagnetic element responsive to a respective electrical signal for positioning said valve member relative to said seat to permit a flow through said valve assembly which is proportional to the strength of the electrical signal applied to the corresponding individual electromagnetic element, a source of water, means connecting said water source to said inlets of said proportional valve assemblies, means connecting the outlets of said proportional valve assemblies respectively to said air atomizing nozzles, means for obtaining a moisture profile in a direction across said web, means responsive to said moisture profile obtaining means for producing a plurality of control signals representing said profile and means for applying said control signals respectively to said electromagnetic elements of said proportional valve assemblies to pass flows of water from the water source through the valve assemblies to the respective air atomizing nozzles, said flows being proportional respectively to the magnitudes of said control signals to tend to make the moisture content across said web constant, each of said valve assemblies comprising means mounting said valve member for movement relative to said seat to permit flow through the valve assembly in proportion to the separation between the valve member and the seat, each of said valve assemblies comprising an elongated armature, means mounting said armature for pivotal movement around an axis intermediate the ends of the armature, said valve member mounting means comprising a rod mounted for movement around said axis with said armature, mens for applying balanced magnetic forces to the ends of the armature to cause it to occupy a neutral position in the absence of any other force applied thereto, said electromagnetic element being a coil carried by said armature, one of said control signals being applied to said coil, said coil being so wound as to produce a force assisting the magnetic force applied to one end of said armature and opposing the force applied to the other end of the armature to tend to rotate said armature to move said valve member away from said seat.

2. A system as in claim 1 in which said seat and said valve member are tapered in a complementary fashion.

3. A system as in claim 2 in which each of said valve assemblies includes means biasing said valve member into engagement with said seat.

4. A system as in claim 3 in which said valve member and said seat are conical.

5. A system as in claim 4 including means for adjusting the force of said biasing means.

* * * * *